US008188659B2

(12) United States Patent
Kim et al.

(10) Patent No.: US 8,188,659 B2
(45) Date of Patent: May 29, 2012

(54) COMPOSITION FOR FORMING A MULTI-LAYERED ELECTRODE AND PLASMA DISPLAY PANEL MANUFACTURED WITH THE SAME

(75) Inventors: Chul-Hong Kim, Suwon-si (KR); Jung-Keun Ahn, Suwon-si (KR); Hyun-Mi Jeong, Suwon-si (KR); Yeon-Joo Choi, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 715 days.

(21) Appl. No.: 12/078,922

(22) Filed: Apr. 8, 2008

(65) Prior Publication Data

US 2008/0265772 A1 Oct. 30, 2008

(30) Foreign Application Priority Data

Apr. 25, 2007 (KR) ..... 10-2007-0040246

(51) Int. Cl.
*H01J 17/49* (2006.01)
*H01J 1/00* (2006.01)
*H01B 1/02* (2006.01)

(52) U.S. Cl. ..... 313/582; 313/586; 252/512; 252/513; 252/514

(58) Field of Classification Search ..... 313/581–587; 252/512–514
See application file for complete search history.

(56) References Cited

U.S. PATENT DOCUMENTS

| | | | | |
|---|---|---|---|---|
| 2002/0096666 | A1 | 7/2002 | Ichikawa et al. | |
| 2004/0232840 | A1 * | 11/2004 | Aoki et al. | 313/582 |
| 2005/0130547 | A1 | 6/2005 | Oida et al. | |
| 2005/0159070 | A1 * | 7/2005 | Banba et al. | 445/24 |
| 2006/0266984 | A1 | 11/2006 | Lee et al. | |
| 2008/0150428 | A1 | 6/2008 | Uriu et al. | |

FOREIGN PATENT DOCUMENTS

| | | | |
|---|---|---|---|
| EP | 1 701 372 | A2 | 9/2006 |
| EP | 1 933 353 | A1 | 6/2008 |
| JP | 01-258303 | A | 10/1989 |
| JP | 09-326208 | A | 12/1997 |
| JP | 11-135904 | A | 5/1999 |
| JP | 11-213893 | A | 8/1999 |
| JP | 2001-006435 | A | 1/2001 |
| JP | 2002 025451 | A | 1/2002 |
| JP | 2003-100208 | A | 4/2003 |
| JP | 2006 128055 | A | 5/2006 |
| WO | WO 2007/040142 | A1 | 4/2007 |

OTHER PUBLICATIONS

European Office Action dated Nov. 2, 2011.

* cited by examiner

*Primary Examiner* — Tracie Y Green
(74) *Attorney, Agent, or Firm* — Lee & Morse, P.C.

(57) ABSTRACT

An electrode composition includes a metal in an amount of about 52% to about 62% by weight of the composition, a glass insulation material in an amount of about 5% to about 7% by weight of the composition, a coloring agent in an amount of about 3% to about 9% by weight of the composition, and a vehicle.

9 Claims, 5 Drawing Sheets

COMPOSITION FOR FORMING A MULTI-LAYERED ELECTRODE AND PLASMA DISPLAY PANEL MANUFACTURED WITH THE SAME

BACKGROUND OF THE INVENTION

1. Field of the Invention

Embodiments of the present invention relate to electrodes and a plasma display panel (PDP) manufactured with the same. More particularly, embodiments of the present invention relate to bus electrodes of a PDP capable of minimizing external light reflection and enhancing operability of the PDP.

2. Description of the Related Art

Generally, a plasma display panel (PDP) refers to a display device capable of displaying images via gas discharge phenomenon, i.e., excitation of a photoluminescent material with vacuum ultraviolet (VUV) light generated by plasma discharge. Accordingly, the PDP may provide superior display characteristics, such as large and thin screen, excellent color reproduction, and wide viewing angles, as compared to conventional display devices.

A conventional PDP, e.g., an alternating current (AC) three-electrode surface-discharge PDP, may include display electrodes on a front substrate, address electrodes on a rear substrate spaced apart from the front substrate, and a discharge space between the front and rear substrates for generating a plasma discharge. Each display electrode may include a bus electrode. A conventional bus electrode may be formed of silver (Ag) by a seven-step photolithography process, e.g., an intaglio process.

However, the seven-step photolithography process may be complex and time-consuming. Further, use of silver (Ag) to form the conventional bus electrode may generate excessive external light reflection, trigger an edge-curl phenomenon, i.e., end portions of the bus electrode may curl due to a difference in a compression rate between both edges and a middle portion of the bus electrode, and cause electron migration between peripheral portions of adjacent bus electrodes. Excessive light reflection may reduce display characteristics of the PDP, while the edge-curl phenomenon and electron migration may decrease electric reliability and operation of the PDP.

SUMMARY OF THE INVENTION

Embodiments of the present invention are therefore directed to a composition for forming bus electrodes and a plasma display panel (PDP) manufactured therewith, which substantially overcome one or more of the disadvantages of the related art.

It is therefore a feature of an embodiment of the present invention to provide an electrode composition capable of decreasing external light reflection therefrom.

It is another feature of an embodiment of the present invention to provide an electrode composition capable of reducing electric shorts therein.

It is yet another feature of an embodiment of the present invention to provide an electrode composition capable of minimizing an edge-curl phenomenon therein.

It is still another feature of an embodiment of the present invention to provide a PDP with a bus electrode structure and composition capable of providing improved operability and reliability thereof.

At least one of the above and other features and advantages of the present invention may be realized by providing a composition for forming electrodes, including a metal in an amount of about 52% to about 62% by weight of the composition, a glass insulation material in an amount of about 5% to about 7% by weight of the composition, a coloring agent in an amount of about 3% to about 9% by weight of the composition, and a vehicle.

The glass insulation material may be frit. The frit may include $B_2O_3$ and BaO at a weight ratio of about 1:1 to about 5:1. The metal may be a metal powder including one or more of silver, gold, aluminum, copper, nickel, chromium, and a silver-palladium alloy. Preferably, the metal may include a silver powder. The coloring agent may include a metal oxide. The coloring agent may be a cobalt oxide or a ruthenium oxide. The vehicle may include an organic solvent and a binder. The organic solvent may be one or more of a ketone, an alcohol, a saturated aliphatic a monocarboxylic acid, an alkyl ester, a lactic acid ester, and an ether-based ester. The binder may be one or more of an acryl-based resin, a styrene resin, a novolac resin, and a polyester resin.

At least one of the above and other features and advantages of the present invention may be further realized by providing a PDP, including first and second substrates facing each other, a plurality of barrier ribs defining a plurality of discharge cells between the first and second substrates, a photoluminescent layer in each discharge cell, and a plurality of display and address electrodes between the first and second substrates, each display electrode having a bus electrode and a transparent electrode, wherein the bus electrode includes a metal material layer surrounded by a colored glass layer and an insulation dummy layer.

The bus electrode may include a metal, a glass insulation material, and a coloring agent at a weight ratio of about 52:5:3 to about 62:7:9. The metal may include a silver powder. The glass insulation material may be frit including $B_2O_3$ and BaO at a weight ratio of about 1:1 to about 5:1. The coloring agent may be a metal oxide including cobalt, ruthenium, or a combination thereof.

The colored glass layer may be between the transparent electrode and the metal material layer. The insulation dummy layer may be along peripheral edges of the metal material layer. An outer surface of the insulation dummy layer may be inclined at a non-right angle with respect to the transparent electrode. The colored glass layer and the insulation dummy layer may be integral to each other.

At least one of the above and other features and advantages of the present invention may be also realized by providing an electrode for a PDP, including a metal material layer having metal in an amount of about 52% to about 62% by weight of the electrode, and a colored glass layer with an insulation dummy layer around the metal material layer, the colored glass layer and the insulation dummy layer including a glass insulation material and a coloring agent, wherein an amount of the glass insulation material may be about 5% to about 7% by weight of the electrode, and an amount of the coloring agent may be about 3% to about 9% by weight of the electrode.

BRIEF DESCRIPTION OF THE DRAWINGS

The above and other features and advantages of the present invention will become more apparent to those of ordinary skill in the art by describing in detail exemplary embodiments thereof with reference to the attached drawings, in which.

DETAILED DESCRIPTION OF THE INVENTION

Figure 1:
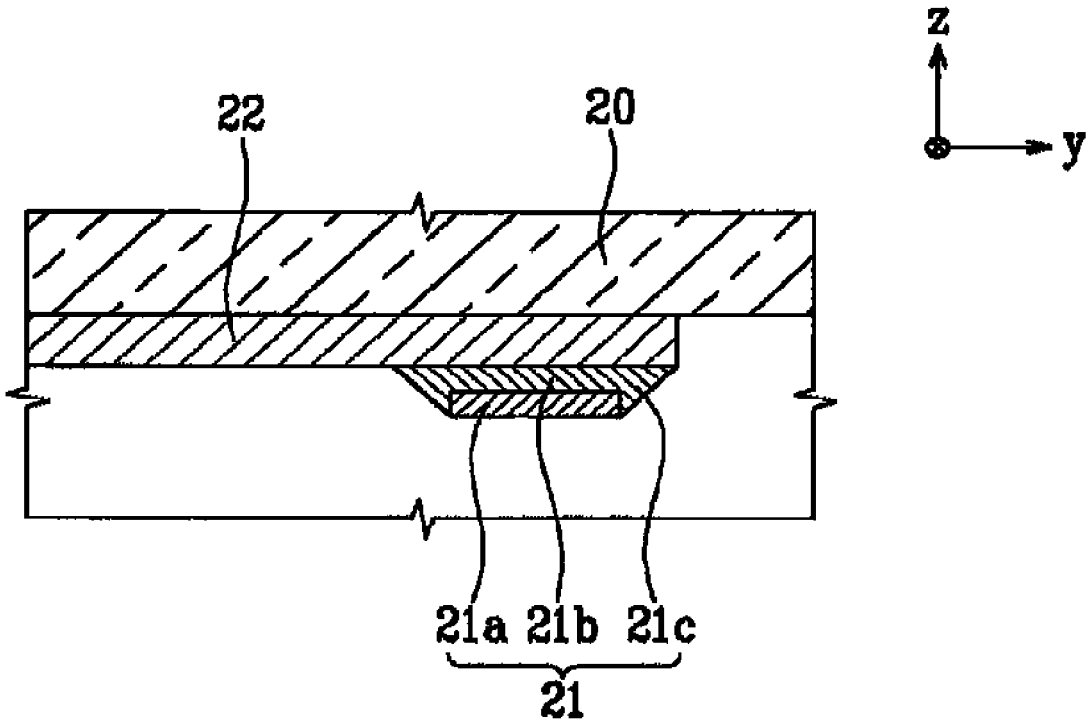
FIG. 1 illustrates a cross-sectional view of an electrode according to an exemplary embodiment of the present invention.

Korean Patent Application No. 10-2007-0040246 filed on Apr. 25, 2007, in the Korean Intellectual Property Office, and entitled: "Composition for Forming Electrodes and Plasma Display Panel Having Electrodes Formed of the Composition," is incorporated by reference herein in its entirety.

Embodiments of the present invention will now be described more fully with reference to the accompanying drawings, in which exemplary embodiments of the invention are illustrated. The invention may, however, be embodied in many different forms and should not be construed as being limited to the embodiments set forth herein. Rather these embodiments are provided so that this disclosure will be thorough and complete, and will fully convey the scope of the invention to those skilled in the art.

In the figures, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

Figure 2:
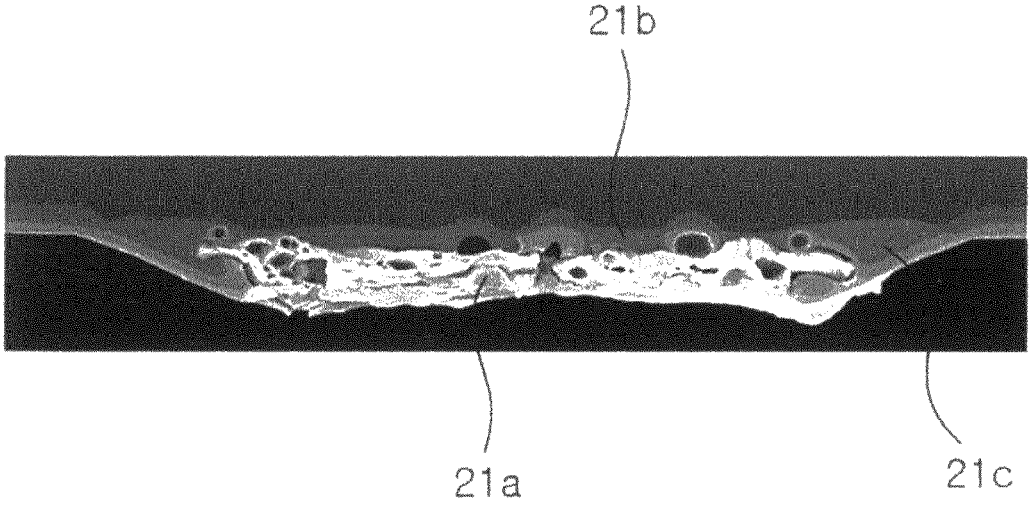
FIG. 2 illustrates an enlarged photograph of the electrode illustrated in FIG. 1.

Exemplary embodiments of electrodes for a plasma display panel (PDP) according to the present invention will now be described in more detail below with respect to FIGS. 1-2. As illustrated in FIGS. 1-2, a bus electrode 21 for a PDP according to an embodiment of the present invention may include a metal material layer 21*a*, a colored glass layer 21*b*, and an insulation dummy layer 21*c*. The bus electrode 21 may be connected to a front substrate 20 of a PDP via a transparent electrode 22, as will be discussed in more detail below with respect to FIGS. 3-4. The bus electrode 21 may be formed of about 52%-62% by wet weight of metal, about 5%-7% by wet weight of glass insulation material, about 3%-9% by wet weight of a coloring agent, and a vehicle. In this respect, it should be noted that all composition amounts are based on "wet weight" and are calculated with respect to a total fluid electrode composition having a vehicle therein, unless indicated otherwise.

The metal material layer 21*a* of the bus electrode 21 may be formed under the transparent electrode 22, i.e., the transparent electrode may be positioned between the front substrate 20 and the metal material layer 21*a*, as illustrated in FIG. 1. The metal material layer 21*a* may be used to apply a discharge voltage to the discharge cells of the PDP, and therefore, may include a metal having a high electric conductivity. More specifically, the the bus electrode paste composition may include about 52%-62% by weight of metal powder, e.g., silver (Ag), gold (Au), aluminum (Al), copper (Cu), nickel (Ni), chromium (Cr), silver-palladium (Ag—Pd) alloy, and so forth.

When the amount of metal is less than about 52% by weight, the amount of metal may be too low to provide sufficient level of electric conductivity to the bus electrode 21. When the amount of metal is greater than about 62% by weight, the amount of non metal may be too low to provide sufficient thickness and uniformity, e.g., color, of the colored glass layer 21*b* and the insulation dummy layer 21*c*, thereby failing to minimize external light reflection, electron migration between adjacent electrodes, and the edge-curl phenomenon.

The colored glass layer 21*b* of the bus electrode 21 may be formed of an insulation glass material, e.g., frit, between the transparent electrode 22 and the metal material layer 21*a*. The colored glass layer 21*b* may also include a coloring agent to impart a predetermined color, i.e., a dark color, thereto, so that the colored glass layer 21*b* may absorb external light incident through the front substrate 20.

If the insulation glass material of the colored glass layer 21*b* includes frit, the frit may include, e.g., a mixture of boron oxide ($B_2O_3$) and barium oxide (BaO). A weight ratio of the $B_2O_3$ to the BaO in the frit may range from about 1:1 to about 5:1. When the weight ratio of the $B_2O_3$ to the BaO is less than about 1:1, i.e., the weight of BaO is larger than the weight of $B_2O_3$, a glass transition temperature of the frit may increase and impede liquid sintering. When the weight ratio of the $B_2O_3$ to the BaO is greater than about 5:1, the electric conductivity of the frit may be excessively reduced. The frit may further include, e.g., silicon oxide ($SiO_2$), lead oxide (PbO), bismuth oxide ($Bi_2O_3$), zinc oxide (ZnO), or a combination thereof at proportions as may be determined by one of ordinary skill in the art.

The coloring agent of the colored glass layer 21*b* may be a metal oxide, e.g., cobalt oxide, ruthenium oxide, and so forth, so that the colored glass layer 21*b* may be dark-colored to increase light absorption rate thereof. Accordingly, when the bus electrode 21 applies the discharge voltage via the metal material layer 21*a*, reflected external light may be absorbed in the dark-colored glass colored layer 21*b*.

The insulation dummy layer 21*c* of the bus electrode 21 may be formed of the same material as the colored glass layer 21*b*, i.e., an insulation glass material and a coloring agent, around the metal material layer 21*a* to increase the absorption rate of external reflected light. The color glass layer 21*b* and the insulation dummy layer 21*c* may be integrally but distinctly formed with the metal material layer 21*a* as different layers, so that the metal material layer 21*a* may be surrounded by the color glass layer 21*b* and the insulation dummy layer 21*c*. Accordingly, the bus electrode 21 may include a total amount of about 5%-7% by weight of insulation glass material and a total amount of about 3%-9% by weight of a coloring agent. The total amount of insulation glass material and coloring agent refers to a cumulative amount of metal in the entire bus electrode 21, including the colored glass layer 21*b* and the insulation dummy layer 21*c*.

When the bus electrode paste composition includes insulation glass material in an amount greater than about 7% by weight, the overall amount of conductive material in the bus electrode 21 may be too low to provide a sufficient level of electric conductivity. When the amount of insulation glass is less than about 5% by weight, formation of the colored glass layer 21*b* and the insulation dummy layer 21*c* may be impaired during the liquid phase sintering of the bus electrode 21.

When the bus electrode paste composition includes a coloring agent in an amount greater than about 9% by weight, the coloring agent may be partially conglomerated in the colored glass layer 21*b* and the insulation dummy layer 21*c*, thereby impairing formation of the colored glass layer 21*b* and the insulation dummy layer 21*c* during the liquid phase sintering of the bus electrode 21. When the amount of coloring agent is less than about 3% by weight, the amount of coloring agent may be too low to impart sufficiently dark color to the colored glass layer 21*b* and the insulation dummy 21*c* for proper light absorption.

The insulation dummy layer 21*a* may surround the metal material layer 21*a*, so that the insulation dummy layer 21*c* may extend along each peripheral side of the metal material layer 21*a*, i.e., along the x-axis, to insulate the metal material layer 21*a*. More specifically, the insulation dummy layer 21*c* may be in communication with the metal material layer 21*a*, the colored glass layer 21*b*, and the transparent electrode 22, so that an outer surface of the dummy layer 21*c* may be angled, i.e., with respect to a plane of the transparent electrode 22, between the metal material layer 21*a* and the transparent electrode 22. In other words, the insulation dummy layer 21*c* may have a triangular cross section, as illustrated in FIGS. 1-2, so two sides of the triangular cross-section may be in communication with the metal material layer 21*a* and the transparent electrode 22, and a third side of the triangular cross section may be inclined at a non-right angle between the transparent electrode 22 and the metal material layer 21*a*.

The colored glass layer 21*b* and the insulation dummy layer 21*c* may be formed on a bottom surface and peripheral surfaces of the metal material layer 21*a*, respectively. In this respect, it should be noted that the "bottom surface" of the metal material layer 21*a* refers to a surface parallel to the transparent electrode 22 and adjacent thereto. Accordingly, an "upper surface" of the material layer 21*a* may refer to an opposite surface of the bottom surface that may be facing away from the transparent electrode 22.

Without intending to be bound by theory, it is believed that formation of the bus electrode 21 of the metal material layer 21*a* with surrounding colored glass layer 21*b* and insulation dummy layer 21*c* may minimize external light reflection. In other words, the dark colored color glass layer 21*b* and insulation dummy layer 21*c* may substantially insulate the metal material layer 21*a*, so that any external light may be substantially absorbed in the dark-colored layers, thereby minimizing light reflection.

Further, insulation of the metal material layer 21*a* by the color glass layer 21*b* and the insulation dummy layer 21*c* may minimize proximity between adjacent metal material layers, thereby preventing potential electron migration and short circuits between closely spaced adjacent electrodes. The insulation dummy layer 21*c* may reduce a pitch and a width of the bus electrode 21, so that the bus electrode 21 may be positioned to correspond to a respective discharge cell with a small pitch, thereby increasing the high density of the PDP. Moreover, since the insulation dummy layer 21*c* may insulate the conductive metal material layer 21*a*, the compression rate between edges and center portions of the electrode 21 may be modified, thereby minimizing occurrence of the edge-curl phenomenon.

Figure 3A:
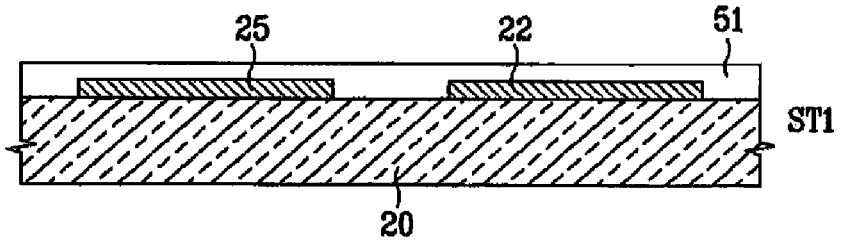
FIGS. 3A-3E illustrate sequential schematic steps of a process for forming the electrode illustrated in FIG. 1.

According to another embodiment of the present invention, a method of forming the bus electrode 21 described previously with respect to FIGS. 1-2 will be discussed in more detail below with reference to FIGS. 3A-3E. As illustrated in FIG. 3A, an electrode layer 51 may be formed on the front substrate 20 to cover transparent electrodes 22 and 25, i.e., step ST1. Next, the electrode layer 51 may be exposed and developed, as illustrated in steps ST2 and ST3 of FIGS. 3B-3C. Finally, the electrode layer 51 may be baked, as illustrated in steps ST4 and ST5 of FIGS. 3D-3E.

More specifically, step ST1 may include formation of the electrode layer 51 of a paste composition having about 52%-62% by weight of metal, about 5%-7% by weight of glass insulation material, about 3%-9% by weight of a coloring agent, and a vehicle. The paste composition may be mixed and deposited on the front substrate 20 with a squeezer, and may be dried to form the electrode layer 51. In this respect, it should be noted that the paste composition of the electrode layer 51 may be identical to the composition of the bus electrode 21 described previously with respect to FIGS. 1-2, and therefore, its detailed description will not be repeated herein.

The metal of the paste composition of the electrode layer 51 may include a metal powder. The metal powder may be of any type as determined by one of ordinary skill in the art, e.g., a granule type, a spherical type, or a flake type. It should be noted, however, that use of a spherical type metal powder may impart additional optical advantages to the metal electrode layer 51 due to the spherical geometrical shape and dispersion property thereof.

For example, silver powder may be used because of its relative low price and slow conductivity deterioration rate triggered by oxidation, i.e., potential processing in air atmosphere. The silver powder may be mixed with the glass insulation material to facilitate solidification of the silver powder and provide sufficient bonding force between the silver powder and the transparent electrodes 22 and 25. Accordingly, the paste of silver and glass insulation material may be process in a backing process to transform the powdered silver into an electrode, as will be discussed in more detail below with respect to FIGS. 3D-3E.

The vehicle of the paste composition of the electrode layer 51 may include an organic solvent and a binder. The composition and proportions of the organic solvent and binder may be determined by one of ordinary skill in the art with respect to a desired viscosity of the electrode forming paste composition. For example, the organic solvent may be a keton, e.g., a diethylketone, a methylbutylketone, a dipropylketone, a cyclohexanone, and so forth; an alcohol, e.g., a n-pentenol, a 4-methyl-2-pentenol, a cyclohexanol, a diacetonealcohol, and so forth; an ether-based alcohol, e.g., an ethyleneglycolmonomethylether, an ethyleneglycolmonoethylether, an ethylene-glycolmonobutylether, a propyleneglycolmonomethylether, a propyleneglycolmonoethylether, and so forth; a saturated aliphatic monocarboxylic acid alkyl ester, e.g., an acetic acid-n-butyl, acetic acidamyl, and so forth; a lactic acid ester, e.g., a lactic acidethyl, a lactic acid-n-butyl, and so forth; an ether-based ester, e.g., a methylcellosolveacetate, ethylcellosolveacetate, propyleneglycolmonomethyletheracetate, ethyl-3-ethoxypropinonate, or 2,2,4-trimethyl-1,3-pentanediolmono(2-methylpropanoate), and so forth; and a combination thereof.

The binder of the vehicle may be any cross-linkable polymer, e.g., via photo-initiator, capable of being easily removed during a developing process. For example, the binder may include an acrylic resin, a styrene resin, a novolac resin, a polyester resin, and so forth. The binder may be a copolymer including a first monomer, a second monomer, a third monomer, or a combination thereof. Each of the first, second, and third monomers may have a carboxyl group.

More specifically, the first monomer may include a carboxyl (COOH) group, e.g., acrylic acid, methacrylic acid, maleic acid, fumaric acid, crotonic acid, itaconic acid, citraconic acid, mesaconic acid, cinamic acid, succinic acidmono (2-(meth) acryloyloxyethyl), a ω-carboxyl-polycaprolactonemono(meth)acrylate, or a combination thereof. The second monomer may include a hydroxide (OH) group, e.g., (meth)acrylic acid2-hydroxyethyl, (meth)acrylic acid2-hydroxypropyl, (meth)acrylic acid 3-hydroxypropyl, o-hydroxystyrene, m-hydroxystyrene, p-hydroxystyrene, or a combination thereof. The third monomer may be a copolymerizable monomer, e.g., a (meth)acrylic acidmethyl, a (meth)acrylic acidethyl, a (meth)acrylic acid n-butyl, a (meth)acrylic acid n-lauryl, a (meth)acrylic acidbenzyl, a glycidyl(meth)acrylate, or a dicyclopentanyl(meth)acrylate; an acidester, e.g., a (meth)acrylic acidester; an aromatic vinyl-based monomer, e.g., a styrene or an α-methylstyrene; or a conjugated diene, e.g., a butadiene or an isoprene; and a micromonomer, e.g., a polystyrene, a poly(meth)acrylic acidmethyl, a poly(meth)acrylic acidethyl, or a poly(meth)acrylic acidbenzyl. The micromonomer may be provided at an end of a polymer chain with a polymerization unsaturated group, e.g., a (meth)acryloyl group.

The cross-linkable polymer of the binder may have an average molecular weight of about 5,000-50,000 and an acid value of about 20-100 mgKOH/g in order to impart sufficient viscosity to the vehicle, while being capable of decomposing during the developing process. When the average molecular weight of the cross-linkable polymer is less than about 5,000, the binder may impart insufficient adhesion between the metal particles and the substrate during the developing process. When the average molecular weight of the cross-linkable polymer is greater than about 50,000, the binder may impair the developing process. When the acid value is less than about 20 mgKOH/g, the solubility of the binder in an aqueous alkaline solution may be insufficient, thereby providing defective development. When the acid value is greater than about 100 mgKOH/g, the adhesion between the metal particles and the substrate may be degraded or the exposed portion may be dissolved during the developing process.

The vehicle of the paste composition may further include a cross-linking agent and a photo-initiator. The cross-linking agent may be employed in the binder in an amount of about 20-150 parts by weight per 100 parts by weight of the binder, and may be any material capable of performing radical copolymerization via a photo-initiator. The cross-linking agent may be a multi-functional monomer, e.g., ethylene glycol diacrylate, ethylene glycol dimethacrylate, trimethylolpropane triacrylate, trimethylolpropane trimethacrylate, tetramethylolpropane tetraacrylate, pentaerythrytol tetraacrylate, tetramethylolpropane tetramethacrylate, and a combination thereof.

When the amount of the cross-linking agent is less than about 20 parts by weight, the exposing sensitivity of the paste composition of the electrode layer 51 may be deteriorated, thereby providing inaccurate electrode pattern during the developing process. When the amount of the cross-linking agent is greater than about 150 parts by weight, a line width of the electrode pattern may be too large, thereby impeding formation of a fine electrode pattern. Therefore, a residue may be created around the electrodes after the backing process is finished.

The photo-initiator of the vehicle may be any material capable of generating radicals during the exposing process and initiating a cross-linking reaction of the cross-linking agent. For example, the photo-initiator may be o-benzoylbenzoic acid methyl; 4,4-bis(dimethylamine)benzophenone; 2,2-diethoxyacetophenone; 2,2-dimethoxy-2-phenyl-2-phenylacetophenone; 2-methyl-[4-(methylthio)phenyl]-2-morpholinopropa-1-one; 2-benzyl-2-dimethylamino-1-(4-morpholinophenyl)-1-butanone; 2,4-diethylthioxanthone (2,4-Diethylthioxanthone); (2,6-dimethoxybenzoyl)-2,4,4-pentylphosphineoxide; and a combination thereof.

An amount of the photo-initiator may be about 10-50 parts by weight per 100 parts by weight of the cross-linking agent. When the amount of the photo-initiator is less than about 10 parts by weight, the exposing sensitivity of the electrode forming paste composition may be reduced. When the amount of the photo-initiator is greater than about 50 parts by weight, a line width of the exposed portion may be increased or a non-exposed portion may not be developed, thereby generating an electrode pattern with an increased line width.

The paste composition of the electrode layer 51 may further include additives. The type and amount of each additive employed in the paste composition may be determined by one of ordinary skill in the art with respect to specific electrode performance requirements. For example, the paste composition may include a sensitizer to improve sensitivity thereof, a polymerization inhibitor and/or an antioxidant to improve property maintenance thereof, an UV light absorber to improve resolution, an antifoaming agent to reduce bubbles in the paste composition, a dispersing agent to improve dispersion, a leveling agent to impart flatness to the electrode layer 51 during the printing process, a plasticizer for improving thixotropy characteristics of the paste composition, and so forth.

Figure 3B:
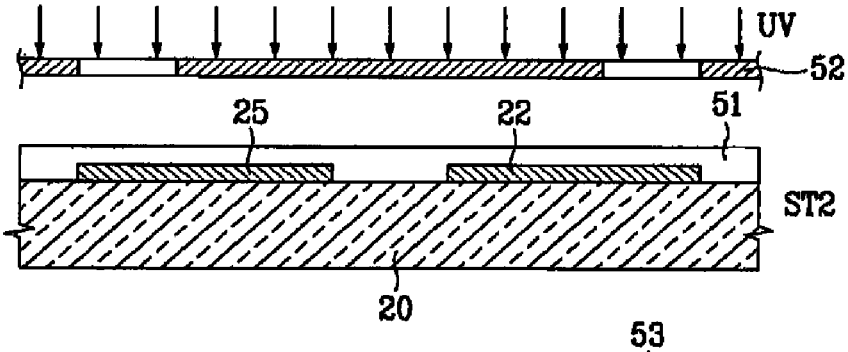
Figure 3C:
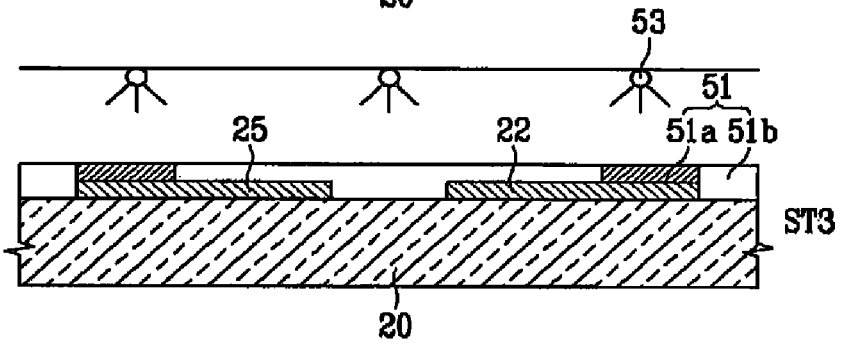

Once the paste composition is formed and the electrode layer 51 is deposited on the front substrate 20, a mask 52 may be disposed above the electrode layer 51, as illustrated in step ST2 of FIG. 3B. The mask 52 may have an address electrodes pattern, i.e., portions of the mask 52 may be removed to expose portions of the electrode layer 51. UV light may be irradiated through the mask 52 toward the electrode layer 51, so that only exposed portions of the electrode layer 51 corresponding to the address electrode pattern of the mask 52 may be irradiated.

Next, i.e., step ST3, a developing agent may be sprayed through a nozzle 53 onto non-exposed portions 51*b* of the electrode layer 51, i.e., non-irradiated portions. The spraying agent may etch the non-exposed portions 51*b*, while exposed portions 51*a* may be dried.

Figure 3D:
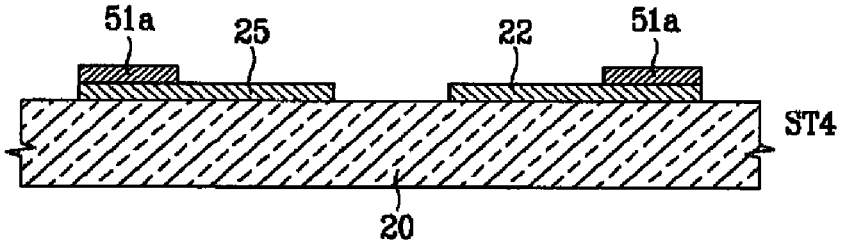
Figure 3E:
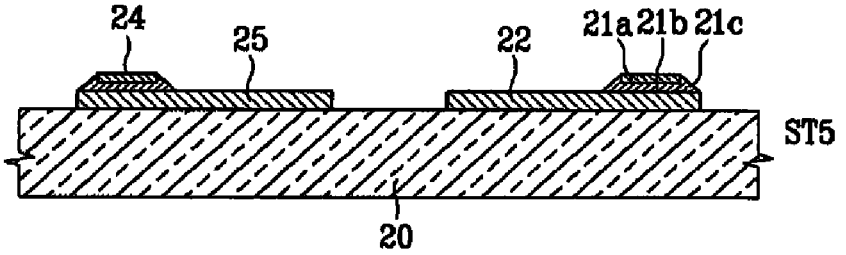

Subsequently, as illustrated in step ST4 of FIGS. 3D-3E, the exposed portions 51*a* of the electrode layer 51 may be baked to form the bus electrodes 21 and 24. More specifically, during the baking process, the vehicle of the paste composition may be decomposed and removed from the electrode forming paste composition, so that only the metal, glass insulation material, and coloring agent may remain. The metal may be solidified by the glass insulation material to form the metal material layer 21*a* at a central portion of the bus electrode 21, while the glass insulation material and coloring agent may form the colored glass layer 21*b* and the insulation dummy layer 21*c*, as discussed previously with respect to FIGS. 1-2, by a liquid-phase ceramic sintering.

Without intending to be bound by theory, it is believed that during the liquid-phase sintering, rearrangement of metal particles may be initiated. More specifically, metal powder particles may be rearranged during the sintering process, so that glass insulation material, e.g., frit, particles may be drawn or pushed away from the metal particles toward a bottom and side surfaces of the electrode layer 51. Accordingly, the electrode layer may be separated during sintering into the metal material layer 21*a* and the glass insulation material, i.e., in a form of the color glass layer 21*b* and the dummy insulation layer 21*c*, surrounding the metal material layer 21*a*, as illustrated in FIG. 3E.

As described above, formation of the colored glass layer 21*b* and the insulation dummy layer 22*c* of a dark color and around the metal material layer 21*a* may significantly reduce reflection of external light and luminance thereof. Additionally, formation of the insulation dummy layer 21*c* around the metal material layer 21*a* may prevent electron migration, thereby minimizing potential shorts due to close proximity of the adjacent bus electrodes 21 and 24. Finally, during the backing process ST5, the insulation dummy layer 21*c* may alleviate a contraction load difference between the edge of the metal material layer 21*a* and the central portion of the metal material layer 21*a*, thereby minimizing edge-curling thereof.

Figure 4:
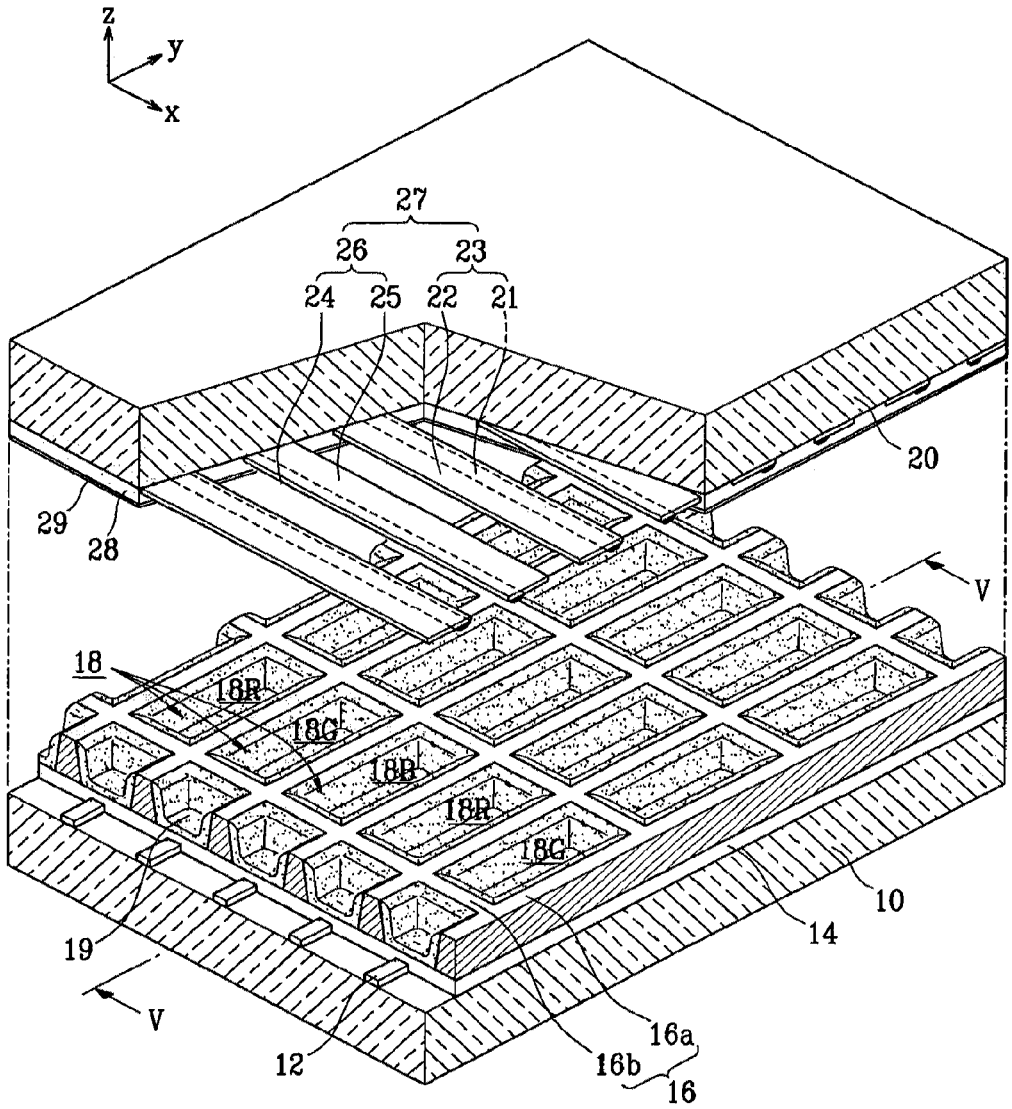
FIG. 4 illustrates a perspective view of a plasma display panel (PDP) including the electrodes illustrated in FIG. 1.
Figure 5:
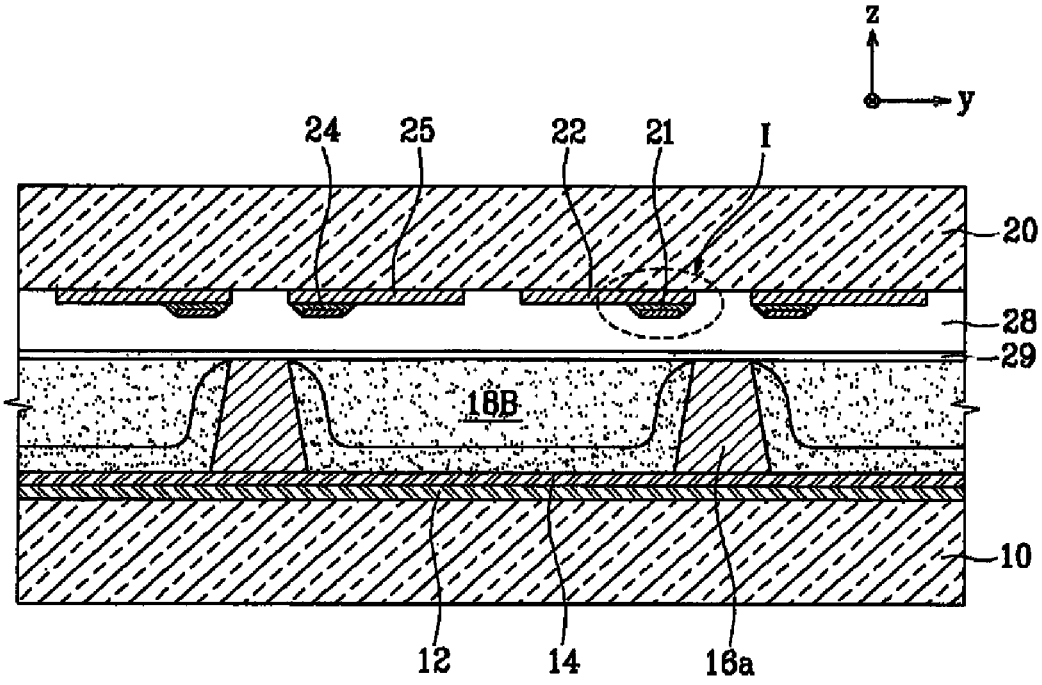
FIG. 5 illustrates a cross-sectional view along line V-V of FIG. 4.

According to yet another embodiment of the present invention illustrated in FIGS. 4-5, a PDP may include the bus electrodes 21 described previously with respect to FIGS. 1-2. More specifically, the PDP may include rear and front substrates 10 and 20, a plurality of discharge cells 18 defined by barrier ribs 16 between the rear and front substrates 10 and 20, address electrodes 12 on the rear substrate 10, and display electrodes 27 on the front substrate 20. Each display electrode 27 may include a bus electrode, as indicated in portion I of FIG. 5, identical to the bus electrode 21 described previously with respect to FIGS. 1-2.

The rear and front substrate 10 and 20 of the PDP may face each other at a predetermined interval, and may be sealed together with a frit member (not shown) disposed on peripheral edges thereof.

The barrier ribs 16 of the PDP may be formed by depositing a dielectric paste on the rear substrate 10, patterning the dielectric paste into a predetermined barrier rib shape, and baking the shaped dielectric paste. The barrier ribs 16 may include longitudinal barrier ribs 16*a* extending in a first direction, i.e., along the y-axis, and lateral barrier ribs 16*b* extending in a second direction, i.e., along the x-axis, and perpendicularly intersecting with the longitudinal barriers 16*b*.

Accordingly, the discharge cells 18 of the PDP defined by the longitudinal and lateral barrier ribs 16*b* and 16*a* may be configured in a matrix pattern. However, other discharge cells 18 configurations, e.g., a stripe pattern or a delta pattern, the plasma display panel of the present invention are within the scope of the present invention. A photoluminescent material 19 may be coated on bottom and side surfaces of the discharge cells 18. The colors of the photoluminescent material 19 formed in the discharge cells 18 may be arranged as determined by one of ordinary skill in the art, so that red, green, and blue lights may be emitted from respective discharge cells 18R, 18G, and 18B. For example, identical colors may be arranged along the first direction and a repetitive color pattern of red, green, and blue may be arranged along the second direction. A discharge gas, e.g., xenon (Xe), neon (Ne), like gases, or a mixture thereof, may be filled into each discharge cell 18 to generate a plasma discharge.

The address electrodes 12 of the PDP may extend in the first direction, i.e., along the y-axis. In other words, each address electrode 12 may correspond to an array of discharge cells 18 along the first direction. A lower dielectric layer 14 may be formed on the rear substrate 10 to cover the address electrodes 12, i.e., the address electrodes 12 may be positioned between the rear substrate 10 and the lower dielectric layer 14, so that the barrier ribs 16 may be formed on the lower dielectric layer 14.

The display electrodes 27 may be arranged on the front substrate 20, and may extend in the second direction, i.e., along the x-axis. The display electrodes 27 may include a plurality of pairs of scan and sustain electrodes 23 and 26, so that each array of discharge cells 18 along the second direction may be positioned between a pair of display electrodes 27, i.e., between a scan electrode 23 and a sustain electrode 26. An upper dielectric layer 28 and a passivation layer 29 may be formed on the front substrate 20, as illustrated in FIG. 1, in order to cover the display electrodes 27. The passivation layer 29 may include a magnesium oxide (MgO) layer formed of a transparent material to minimize potential plasma discharge damage to the upper dielectric layer 28. In addition, since MgO may have a relatively high secondary electron emission coefficient, the passivation layer 29 may reduce firing voltages on the upper dielectric layer 28.

Each of the scan and sustain electrodes 23 and 26 of the display electrodes 27 may include a respective transparent electrode 22 and 25 positioned above a corresponding lateral barrier ribs 16*b*, and a respective bus electrode 21 and 24 on the corresponding transparent electrode 22 and 25.

The transparent electrodes 22 and 25 may be arranged on the front substrate 20, i.e., between the front substrate 20 and the barrier ribs 16, in a stripe pattern along the second direction to correspond to the red, green, and blue discharge cells 18R, 18G, and 18B. The transparent electrodes 22 and 25 may be formed of a transparent material, e.g., indium-tin oxide (ITO), to minimize blocking of visible light. However, other configurations of the transparent electrodes 22 and 25, e.g., the transparent electrodes 22 and 25 may individually protrude from the bus electrodes 21 and 24 to correspond to the red, green, and blue discharge cells 18R, 18G, and 18B, are within the scope of the present invention.

The bus electrodes 21 and 24 may be positioned on respective transparent electrodes 22 and 25, so that each bus electrode 21 and 24 may be between a respective transparent electrode 22 and 25 and a respective lateral barrier rib 16*b*. Close proximity between the bus electrodes 21 and 24 and the lateral barrier ribs 16*b* may increase transmittance of visible light emitted from the discharge cells 18 toward the front substrate 20. The metal material layer 21*a* of the bus electrode 21 may extend in the second direction to apply a discharge voltage to the corresponding discharge cell 18.

In this respect, it should be noted that the bus electrode 21 of the scan electrode 23 is substantially identical to the bus electrode 24 of the sustain electrode 26, and therefore, all descriptions herein with respect to the structure and composition of the bus electrode 21 may be applicable to the bus electrode 24 of the scan electrode 26 as well. Further, since the composition and structure of the bus electrode 23 was previously described with respect to FIGS. 1-2, its detailed description will not be repeated herein.

A method of driving the PDP is as follows. A reset pulse may be applied to the scan electrodes 23 during a reset period to trigger a reset discharge, i.e., reset all discharge cells 18. Next, a scan pulse may be applied to the scan and address electrodes 23 and 12 during a scan period to trigger an address discharge, i.e., select discharge cells 18 to be operated. Then, a sustain pulse may be alternately applied to the sustain and scan electrodes 26 and 23 during a sustain period to generate a sustain discharge, i.e., to trigger light emission in the selected discharge cells 18. It should be noted that the sustain, scan electrodes, and address electrodes 26, 23, and 12 may vary their functions with respect to voltage waveforms applied thereto, and therefore, other electrode functions are within the scope of the present invention.

EXAMPLES

Seven (7) samples, i.e., Examples 1-5 and Comparative Examples 1-2, of electrode forming paste composition were formed with different proportions of frit and coloring agent. The electrode forming paste compositions were used to form bus electrodes for PDPs. The bus electrodes were observed for an edge-curl phenomenon and quality of coloring thereof.

Example 1 silver powder, frit, and cobalt oxide were mixed to form an electrode forming paste composition. The silver powder, frit, and cobalt oxide were used at a weight ratio of 58:5:6, while the remainder was a vehicle. The frit included $SiO_2$, PbO, $Bi_2O_3$, ZnO, $B_2O_3$, and BaO, and a weight ratio of the $B_2O_3$ to BaO was 1.

A glass substrate having dimensions of 10 cm×10 cm was prepared, cleaned, and dried. Then, the electrode forming paste composition was printed on the glass substrate through a screen-printing process. Next, the glass substrate with the electrode forming paste composition was dried at 100° C. for 15 minutes to form a photosensitive conductive layer.

A photo-mask having a stripe pattern was positioned above the photosensitive conductive layer, and a high pressure mercury lamp was used to irradiate UV light having a wavelength of 450 mJ/cm$^2$ through the photo-mask toward the photosensitive conductive layer. An aqueous sodium carbonate solution (0.4 wt. % at 35° C.) was sprayed at 1.5 kgf/cm$^2$ pressure for 25 seconds to etch non-irradiated portions of the photosensitive conductive layer to form an electrode pattern. The electrode pattern was loaded into an electric backing furnace and baked at 580° C. for 15 minutes to form a bus electrode having a thickness of 4 μm.

An anisotropic conductive film and a tape carrier package were disposed on the bus electrode and bonded through a pressing process to attach the bus electrode to a substrate of a PDP.

Example 2 a bus electrode was prepared and attached to a substrate of a PDP according to the procedure described in Example 1 with the exception of using silver powder, frit, and cobalt oxide at a weight ratio of 58:6:6.

Example 3 a bus electrode was prepared and attached to a substrate of a PDP according to the procedure described in Example 1 with the exception of using silver powder, frit, and cobalt oxide at a weight ratio of 58:7:6.

Example 4 a bus electrode was prepared and attached to a substrate of a PDP according to the procedure described in Example 1 with the exception of using silver powder, frit, and cobalt oxide at a weight ratio of 58:6:3.

Example 5 a bus electrode was prepared and attached to a substrate of a PDP according to the procedure described in Example 1, with the exception of using silver powder, frit, and cobalt oxide at a weight ratio of 58:6:9.

Comparative Example 1 a bus electrode was prepared and attached to a substrate of a PDP according to the procedure described in Example 1, with the exception of using silver powder, frit, and cobalt oxide at a weight ratio of 58:4:10.

Comparative Example 2 a bus electrode was prepared and attached to a substrate of a PDP according to the procedure described in Example 1, with the exception of using the silver powder, frit, and cobalt oxide at a weight ratio of 58:8:2.

In each of the PDPs of Examples 1-5, the colored glass layer and the insulation dummy layer were formed in the bus electrode and reduced the external light reflection luminance. The edge-curl phenomenon was not observed. In this respect, it should be noted that coloring and edge-curl observations were conducted as visual examinations. Uniform and dark coloring was set as an indicator of proper light absorption.

In the PDPs of Comparative Examples 1-2 the amounts of the frit and the cobalt oxide were either too low or too high. In the Comparative Example 1, the colored layer and the insulation dummy layer were not sufficiently thick to prevent the edge-curl phenomenon. Further, the cobalt oxide was partially conglomerated in the colored glass layer and the insulation dummy layer, thereby imparting non-uniform coloring thereto. In the Comparative Example 2, the colored glass layer and the insulation dummy did not exhibit sufficient dark color to effectively absorb reflect light.

As described above, the electrode forming paste composition according to embodiments of the present invention, may include metal, glass insulation material, and a coloring agent at a weight ratio of about 52-62:5-7:3-9, and processed via liquid-phase sintering. Particles of the metal powder and the colored glass layer and insulation dummy layer may be formed together, thereby simplifying the manufacturing process and reducing costs thereof. In addition, since the colored glass layer and the insulation dummy layer may be formed together with the metal material layer, the external light reflection luminance may be reduced.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A plasma display panel (PDP), comprising:

first and second substrates facing each other;

a plurality of barrier ribs defining a plurality of discharge cells between the first and second substrates;

a photoluminescent layer in each discharge cell; and a plurality of display and address electrodes between the first and second substrates, each display electrode having a bus electrode and a transparent electrode, wherein:

Wherein the bus electrode is a metal layer within a multi-layered structure that includes the metal material layer, a colored glass layer, and an insulation dummy layer; the colored glass layer and the insulation dummy layer being integral to each other and includes triangular cross sections at opposing ends of the metal material layer of the bus electrode; wherein the multi-layered structure further includes the metal material layer, the glass insulation material, and the coloring agent at a weight ratio of about 52:5:3 to about 62:7:9, and the glass insulation material is a frit including $B_20_3$ and BaO at a weight ratio of about 1:1 to about 5:1.

2. The PDP as claimed in claim 1, wherein the metal includes a silver powder.

3. The PDP as claimed in claim 1, wherein the coloring agent is a metal oxide including a cobalt, a ruthenium, or a combination thereof.

4. The PDP as claimed in claim 1, wherein the colored glass layer is between the transparent electrode and the metal material layer.

5. The PDP as claimed in claim 1, wherein the insulation dummy layer is along peripheral edges of the metal material layer.

6. The PDP as claimed in claim 1 wherein an outer surface of the insulation dummy layer is inclined at a non-right angle with respect to the transparent electrode.

7. A bus electrode within a multi-layered structure, the multi-layered structure comprising:

a metal material layer, the metal material layer including a metal; and a colored glass layer and an insulation dummy layer surrounding the metal material layer, the colored glass layer and the insulation dummy layer being integral to each other, and the insulation dummy layer including, triangular cross sections at opposing ends of the metal material layer, wherein:

the colored glass layer and the insulation dummy layer include a glass insulation material and a coloring agent, a weight ratio of the metal material layer, the glass insulation material, and the coloring agent is being about 52:5:3 to about 62:7:9, and the glass insulation material is a frit including $B_2O_3$ and BaO at a weight ratio of about 1:1 to about 5:1.

8. The PDP as claimed in claim 1, wherein the triangular cross sections of the insulation dummy layer include:

a first triangular cross section at a first end of the metal material layer, the first triangular cross section including a first side in communication with the metal material layer, a second side in communication with the transparent electrode, and a third side inclined at a first non-right angle between the metal material layer and the transparent electrode, and a second triangular cross section at a second end of the metal material layer, the second end opposing the first end, and the second triangular cross section including a first side in communication with the metal material layer, a second side in communication with the transparent electrode, and a third side inclined at a second non-right angle between the metal material layer and the transparent electrode.

9. The PDP as claimed in claim 1, wherein the triangular cross sections of the insulation dummy layer are substantially only formed of the glass insulation material.

* * * * *